US011533950B1

(12) United States Patent
Wu

(10) Patent No.: US 11,533,950 B1
(45) Date of Patent: Dec. 27, 2022

(54) ATOMIZER CARTRIDGE WITH INTEGRALLY FORMED INTERNAL FLUID RESERVOIR AND MOUTHPIECE PORTION

(71) Applicant: CLEAR IP Corporation, Stafford, TX (US)

(72) Inventor: Jeff Wu, Stafford, TX (US)

(73) Assignee: Clear IP Corporation, Stafford, TX (US)

( * ) Notice: Subject to any disclaimer, the term of this patent is extended or adjusted under 35 U.S.C. 154(b) by 0 days.

(21) Appl. No.: 17/668,341

(22) Filed: Feb. 9, 2022

(51) Int. Cl.

| | |
|---|---|
| ***A24F 13/00*** | (2006.01) |
| ***A24F 40/42*** | (2020.01) |
| ***A24F 40/485*** | (2020.01) |
| ***A24F 40/46*** | (2020.01) |
| ***A24F 40/44*** | (2020.01) |
| ***A24F 40/10*** | (2020.01) |
| ***A24F 7/00*** | (2006.01) |

(52) U.S. Cl.
CPC ..... *A24F 40/42* (2020.01); *A24F 7/00* (2013.01); *A24F 40/10* (2020.01); *A24F 40/44* (2020.01); *A24F 40/46* (2020.01); *A24F 40/485* (2020.01)

(58) Field of Classification Search
CPC ..... A24F 47/00
USPC ..... 131/328–329
See application file for complete search history.

(56) References Cited

U.S. PATENT DOCUMENTS

| | | | |
|---|---|---|---|
| 9,497,998 | B2 | 11/2016 | Chen |
| 9,504,279 | B2 | 11/2016 | Chen |
| 9,572,373 | B2 | 2/2017 | Chen |
| 9,603,389 | B2 | 3/2017 | Chen |
| 9,675,118 | B2 | 6/2017 | Chen |
| 9,770,054 | B2 | 9/2017 | Chen |
| 9,795,167 | B2 | 10/2017 | Chen |
| 9,861,129 | B2 | 1/2018 | Liu |
| 9,861,135 | B2 | 1/2018 | Chen |
| 9,888,720 | B2 | 2/2018 | Chen |
| 9,888,722 | B2 | 2/2018 | Chen |
| 9,943,109 | B2 | 4/2018 | Chen |
| 9,949,511 | B2 | 4/2018 | Liu |
| 9,956,357 | B2 | 5/2018 | Chen |
| 9,980,513 | B2 | 5/2018 | Chen |
| 9,999,248 | B2 | 6/2018 | Liu |
| 10,051,889 | B2 | 8/2018 | Chen |
| 10,058,126 | B2 | 8/2018 | Chen |
| 10,117,461 | B2 | 11/2018 | Chen |
| 10,188,146 | B2 | 1/2019 | Chen |
| 10,195,370 | B2 | 2/2019 | Chen |

(Continued)

*Primary Examiner* — Phuong K Dinh
(74) *Attorney, Agent, or Firm* — Polsinelli PC

(57) ABSTRACT

Systems and techniques are provided for an atomizer assembly comprising a mouthpiece portion, a longitudinal vapor channel, an internal fluid reservoir, and an atomizer. An outer surface of the mouthpiece portion includes a vapor outlet, coupled to a first distal end of the longitudinal vapor channel. The internal fluid reservoir is integrally formed with the mouthpiece portion as a single-piece construction, wherein the internal fluid reservoir comprises an empty volume disposed between an outer surface of the longitudinal vapor channel and an inner surface of the mouthpiece portion. The atomizer is configured to receive a fluid stored in the internal fluid reservoir of the mouthpiece portion, wherein the atomizer includes at least one heating element for vaporizing the fluid received from the internal fluid reservoir of the mouthpiece portion.

17 Claims, 5 Drawing Sheets

(56) References Cited

U.S. PATENT DOCUMENTS

| | | | | |
|---|---|---|---|---|
| 10,306,929 | B2 | 6/2019 | Liu | |
| 10,349,678 | B2 | 7/2019 | Chen | |
| 10,357,623 | B2 | 7/2019 | Fang | |
| 10,433,590 | B2 | 10/2019 | Liu | |
| 10,463,081 | B2 | 11/2019 | Chen | |
| 10,492,539 | B2 | 12/2019 | Chen | |
| 10,506,827 | B2 * | 12/2019 | Guo | A24F 40/05 |
| 10,506,834 | B2 | 12/2019 | Lin | |
| 10,555,557 | B2 | 2/2020 | Liu | |
| 10,624,391 | B2 | 4/2020 | Chen | |
| 10,631,578 | B2 | 4/2020 | Chen | |
| 10,750,781 | B2 | 8/2020 | Chen | |
| 10,750,790 | B2 | 8/2020 | Chen | |
| 10,772,353 | B2 | 9/2020 | Liu | |
| 10,791,762 | B2 | 10/2020 | Liu | |
| 10,791,763 | B2 | 10/2020 | Chen | |
| 10,791,764 | B2 | 10/2020 | Chen | |
| 10,849,364 | B2 | 12/2020 | Chen | |
| 10,869,500 | B2 | 12/2020 | Chen | |
| 10,893,706 | B2 | 1/2021 | Wei | |
| 10,905,157 | B2 | 2/2021 | Lai | |
| 10,973,262 | B2 | 4/2021 | Li | |
| 10,986,868 | B2 | 4/2021 | Chen | |
| 10,993,475 | B2 | 5/2021 | Chen | |
| 11,006,672 | B2 | 5/2021 | Wei | |
| 11,013,263 | B2 | 5/2021 | Wu | |
| 11,051,550 | B2 * | 7/2021 | Lin | A24F 40/485 |
| 11,083,223 | B2 | 8/2021 | Chen | |
| 11,122,838 | B2 | 9/2021 | Wu | |
| 11,123,503 | B2 | 9/2021 | Fang | |
| 2014/0109921 | A1 | 4/2014 | Chen | |
| 2014/0182612 | A1 | 7/2014 | Chen | |
| 2015/0090281 | A1 | 4/2015 | Chen | |
| 2015/0272218 | A1 | 10/2015 | Chen | |
| 2016/0128387 | A1 | 5/2016 | Chen | |
| 2016/0278163 | A1 | 9/2016 | Chen | |
| 2016/0302487 | A1 | 10/2016 | Chen | |
| 2019/0335809 | A1 | 11/2019 | Han | |
| 2019/0373949 | A1 | 12/2019 | Pan | |
| 2020/0009336 | A1 | 1/2020 | Feng | |
| 2020/0046024 | A1 | 2/2020 | Chen | |
| 2020/0068951 | A1 | 3/2020 | Li | |
| 2020/0085101 | A1 | 3/2020 | Wu | |
| 2020/0085108 | A1 | 3/2020 | Li | |
| 2020/0086067 | A1 | 3/2020 | Li | |
| 2020/0107583 | A1 | 4/2020 | Wu | |
| 2020/0107584 | A1 | 4/2020 | Li | |
| 2020/0163390 | A1 | 5/2020 | Yang | |
| 2020/0187568 | A1 | 6/2020 | Li | |
| 2020/0205476 | A1 | 7/2020 | Wen | |
| 2020/0214353 | A1 | 7/2020 | Hu | |
| 2020/0236995 | A1 | 7/2020 | Zhou | |
| 2020/0288779 | A1 | 9/2020 | Chen | |
| 2020/0352228 | A1 | 11/2020 | Chen | |
| 2020/0359692 | A1 | 11/2020 | Liu | |
| 2020/0367564 | A1 | 11/2020 | Li | |
| 2020/0375248 | A1 | 12/2020 | Chen | |
| 2020/0390151 | A1 | 12/2020 | Liu | |
| 2020/0390152 | A1 | 12/2020 | Liu | |
| 2020/0397043 | A1 | 12/2020 | Li | |
| 2021/0000178 | A1 | 1/2021 | Chen | |
| 2021/0000179 | A1 | 1/2021 | Li | |
| 2021/0000181 | A1 | 1/2021 | Li | |
| 2021/0001057 | A1 | 1/2021 | Chen | |
| 2021/0007399 | A1 | 1/2021 | Wu | |
| 2021/0016049 | A1 | 1/2021 | Yl | |
| 2021/0030066 | A1 | 2/2021 | Xiao | |
| 2021/0030070 | A1 | 2/2021 | Sun | |
| 2021/0084984 | A1 | 3/2021 | Yao | |
| 2021/0137159 | A1 | 5/2021 | Ou | |
| 2021/0161207 | A1 | 6/2021 | Li | |
| 2021/0177048 | A1 | 6/2021 | Li | |
| 2021/0186088 | A1 | 6/2021 | Li | |
| 2021/0195940 | A1 | 7/2021 | Li | |
| 2021/0195941 | A1 | 7/2021 | Li | |
| 2021/0212375 | A1 | 7/2021 | Chen | |
| 2021/0235765 | A1 | 8/2021 | Wei | |
| 2021/0307396 | A1 | 10/2021 | Xu | |
| 2021/0345675 | A1 | 11/2021 | Chen | |
| 2021/0360977 | A1 | 11/2021 | Lai | |
| 2021/0386121 | A1 | 12/2021 | Wen | |
| 2021/0386941 | A1 | 12/2021 | Bie | |
| 2022/0007728 | A1 | 1/2022 | Wu | |
| 2022/0007731 | A1 | 1/2022 | Lei | |
| 2022/0016367 | A1 | 1/2022 | Fang | |

* cited by examiner

ATOMIZER CARTRIDGE WITH INTEGRALLY FORMED INTERNAL FLUID RESERVOIR AND MOUTHPIECE PORTION

TECHNICAL FIELD

The present disclosure relates generally to systems and techniques for vaporizing fluid, and more specifically pertains to an atomizer cartridge assembly thereof.

BACKGROUND

Electronic cigarettes and vaporizers can be used to produce inhalable vapor from various fluids, oils, and liquids. For example, vapor can be produced from fluids that contain nicotine and/or flavoring agents. Users can inhale such vapors produced by an electronic cigarette or vaporizer device as an alternative to smoking burned or combusted matter, which is often organic and can contain various combustion byproducts that may be associated with undesirable health effects.

As electronic cigarettes and vaporizer devices have grown in popularity, so too has the range of different vaporization fluids, flavors, etc., grown in response. In some cases, vaporization fluid can be provided separately from an electronic cigarette or vaporization device, e.g., in a 'pod' or cartridge form that can be detachably coupled to a user's electronic cigarette or vaporization device. In this manner, a single electronic cigarette or vaporization device can be utilized with multiple different vaporization fluids or flavors, based on a user's selection of a pod or cartridge to install on their electronic cigarette or vaporization device. Accordingly, there is a need for a vaporizer or atomizer cartridge that can easily be coupled to a user's electronic cigarette or vaporization device but contains a reduced number of separate parts and/or occupies a reduced spatial volume.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof, which are illustrated in the appended drawings. Understand that these drawings depict only exemplary embodiments of the disclosure and are not, therefore, to be considered to be limiting of its scope, the principles herein are described and explained with additional specificity and detail through the use of the accompanying drawings in which.

DETAILED DESCRIPTION

Figure 1:
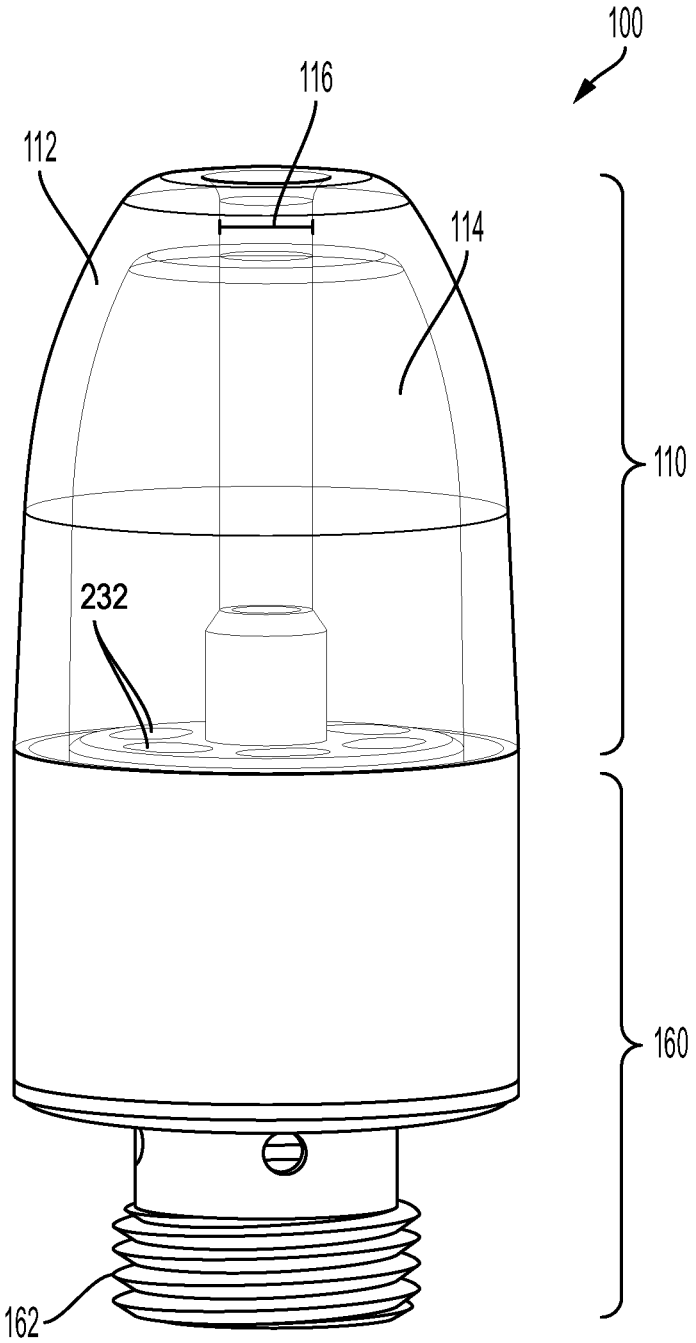
FIG. 1 illustrates a perspective view of an example atomizer cartridge assembly.

Various embodiments of the disclosure are discussed in detail below. While specific implementations are discussed, it should be understood that this is done for illustration purposes only. A person skilled in the relevant art will recognize that other components and configurations may be used without departing from the spirit and scope of the disclosure. Additional features and advantages of the disclosure will be outlined in the description which follows, and in part will be obvious from the description, or can be learned by practice of the herein disclosed principles. It will be appreciated that for simplicity and clarity of illustration, where appropriate, reference numerals have been repeated among the different figures to indicate corresponding or analogous elements. The description is not to be considered as limiting the scope of the embodiments described herein.

FIG. 1 is a perspective view of an example atomizer cartridge assembly 100, according to one or more aspects of the present disclosure. In some embodiments, the atomizer cartridge assembly 100 can be attached to a vaporizer housing (e.g., an electronic cigarette body) and used to vaporize a fluid stored in an internal reservoir of the atomizer cartridge assembly 100. In addition to the internal reservoir for storing a fluid, the atomizer cartridge assembly 100 can further include a heating element and one or more mechanisms for delivering the fluid from the internal reservoir to the heating element. The heating element receives electrical power from an internal or external power supply (or a combination of the two) and generates heat to vaporize the fluid delivered to the heating element. When the atomizer cartridge assembly 100 is attached to an electronic cigarette or other vaporizer body, the electronic cigarette can comprise the external supply of electrical power to the heating element of the atomizer cartridge assembly 100. In some embodiments, the heating element can be an atomizer heating element. Vaporized fluid produced by the heating element of atomizer cartridge 100 can then be inhaled or otherwise delivered to a user of the atomizer cartridge assembly 100, as will be explained in greater depth below.

As illustrated, the atomizer cartridge assembly 100 includes an upper assembly 110 and a lower assembly 160, which are described in turn below. It is noted that the upper assembly 110 and the lower assembly 160 can be detachably connected or can be provided in a unitary construction. For example, in some embodiments, upper assembly 110 and lower assembly 160 can be attached via a friction fit or a press fit. In some embodiments, upper assembly 110 can be integrally formed to comprise a mouthpiece housing 112, a vapor channel 116, and a fluid reservoir 114 (wherein the fluid reservoir 114 is defined between an inner surface of mouthpiece housing 112 and an outer surface of vapor channel 116). For example, upper assembly 110 can be provided as a single piece of injection-molded plastic, wherein the physical injection mold occupies the empty volume of fluid reservoir 114 during the injection molding manufacturing process.

In some examples, one or more components of the atomizer cartridge assembly 100 (e.g., in addition to upper assembly 110) can be provided as injection-molded plastic and/or formed from other plastic material(s). For example, one or more components or portions of lower assembly 160 can be provided as injection-molded plastic or otherwise formed from plastic material(s), as will be described in greater depth below. In some embodiments, upper assembly 110 and/or lower assembly 160 can include one or more components formed from plastic material(s) such that any oils or fluids stored in fluid reservoir 114 (and later consumed using the atomizer cartridge assembly 100) do not come in to contact with any metal materials prior to consumption/vaporization by the atomizer cartridge assembly 100. For instance, a fluid or oil stored in fluid reservoir 114 (e.g., a fluid used or consumed via atomizer cartridge assembly 100) may be acidic, basic, or otherwise have chemical properties that may cause undesirable reactions (e.g., corrosion, degradation, etc.) with materials the fluid or oil contacts. In one illustrative example, one or more components of atomizer cartridge assembly 110 can be provided as plastic material(s) that are non-reactive with one or more types of oils and/or fluids that may be stored in fluid reservoir 114 and consumed using atomizer cartridge assembly 100. In some examples, any oils or fluids stored in fluid reservoir 114 do not make contact with any non-plastic materials before being provided to the lower assembly 160 for vaporization (e.g., oils or fluids stored in fluid reservoir 114 do not contact any non-plastic materials prior to being absorbed by one or more wicking materials or absorbent pads disposed about the outer surface of an atomizer located in lower assembly 160).

In some cases, the single-piece construction of upper assembly 110 can have a decreased production cost and/or an increased speed and efficiency of manufacture. Moreover, the single-piece construction offers a simpler but more robust experience for users of atomizer cartridge assembly 100, as users will no longer handle separate parts that can be damaged, lost, connected incorrectly, etc., as may be experienced with existing solutions. For example, rather than utilizing separate components to perform different tasks, in operation, the single-piece upper assembly 110 can function simultaneously as a mouthpiece for delivering vaporized fluid to a user, as a fluid reservoir for storing the vaporization fluid, and as a vapor coupling for transmitting vaporized fluid from the heating element to mouthpiece outlet.

In addition to offering improved simplicity by way of the single-piece construction of upper assembly 110, the atomizer cartridge assembly 100 can also be used in a modular fashion with different vaporizer housings, bases, electronic cigarettes, etc. For example, the lower assembly 160 can include a base connector 162 to provide a detachable coupling between the atomizer cartridge assembly 100 and one or more different vaporizer housings. As illustrated in FIG. 1, base connector 162 can be a threaded connector located at a distal end of the lower assembly 160. However, it is appreciated that various other connection mechanisms can also be utilized for base connector 162 and/or that base connector 162 can be provided at locations other than the distal end of lower assembly 160.

In some embodiments, base connector 162 can include one or more power distribution elements (e.g., positive and negative battery leads) that receive electrical power and couple the electrical power to an internal heating element disposed within lower assembly 160. Base connector 162 can receive electrical power from a source that is external to the atomizer cartridge assembly 100, such as an electronic cigarette or other vaporizer housing that is attached to atomizer cartridge assembly 100 via base connector 162 (e.g., an electronic cigarette or vaporizer housing can have an internal battery that is an external power source to atomizer cartridge assembly 100). Additionally or alternatively, base connector 162 can receive electrical power from a source that is internal to or otherwise associated with the atomizer cartridge assembly 100. For example, although not depicted in FIG. 1, in some cases atomizer cartridge assembly 100 can be configured with one or more batteries that provide electrical power to the internal heating element of lower assembly 160.

Figure 2A:
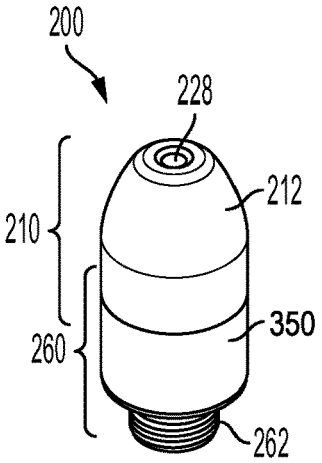
FIG. 2A illustrates a perspective view of an example atomizer cartridge assembly.
Figure 2B:
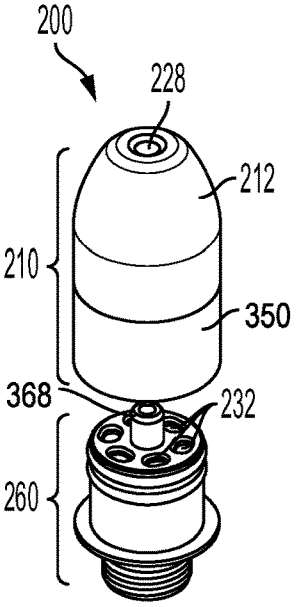
FIG. 2B illustrates a partially exploded perspective view of the example atomizer cartridge assembly of FIG. 2A.
Figure 2C:
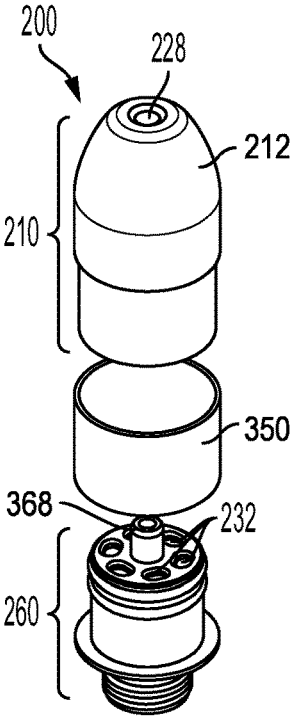
FIG. 2C illustrates another partially exploded perspective view of the example atomizer cartridge assembly of FIGS. 2A and 2B.
Figure 3A:
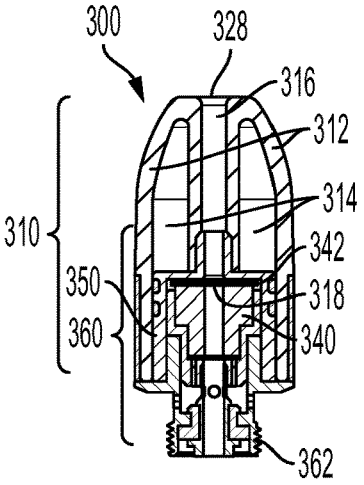
FIG. 3A illustrates a cross-sectional view of an example atomizer cartridge assembly.
Figure 3B:
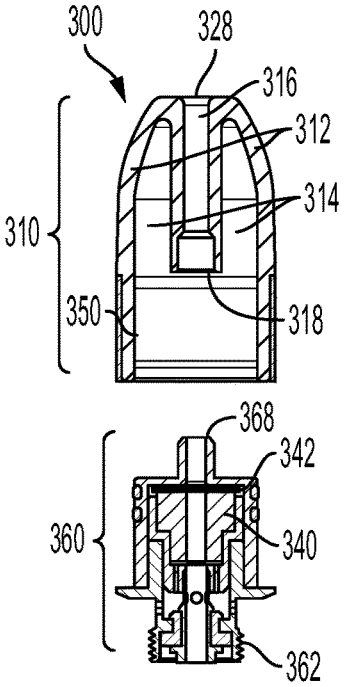
FIG. 3B illustrates a partially exploded cross-sectional view of the example atomizer cartridge assembly of FIG. 3A.
Figure 3C:
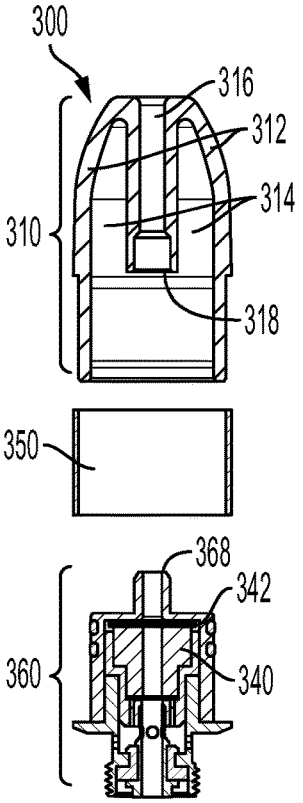
FIG. 3C illustrates another partially exploded cross-sectional view of the example atomizer cartridge assembly of FIGS. 3A and 3B.
Figure 4A:
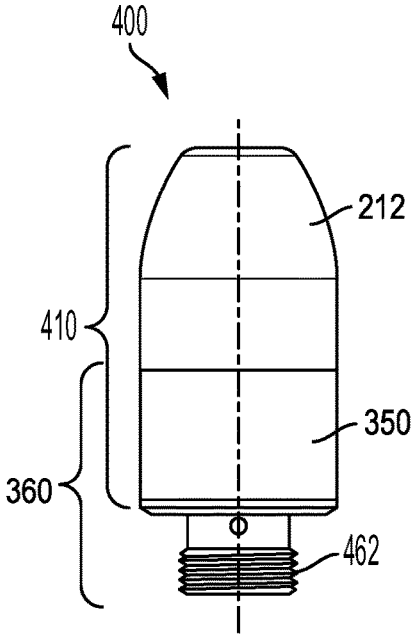
FIG. 4A illustrates a side view of an example atomizer cartridge assembly.
Figure 4B:
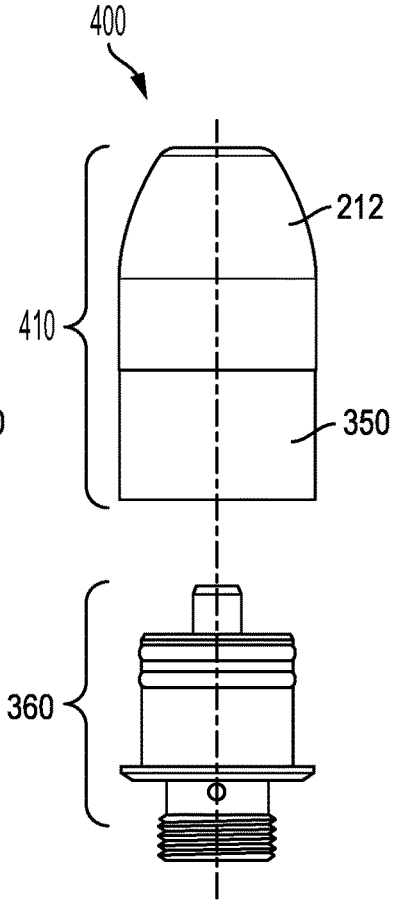
FIG. 4B illustrates a partially exploded side view of the example atomizer cartridge assembly of FIG. 4A.
Figure 4C:
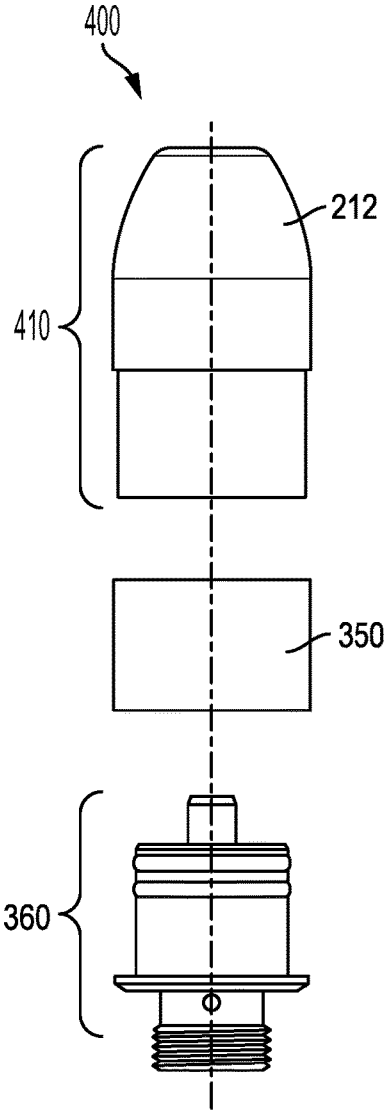
FIG. 4C illustrates another partially exploded side view of the example atomizer cartridge assembly of FIGS. 4A and 4B.

The disclosure turns now to FIGS. 2A-4C, which depict various views of example atomizer cartridge assemblies according to aspects of the present disclosure. FIGS. 2A-C are perspective views of an example atomizer cartridge assembly 200 and progress from showing a fully assembled state (e.g., FIG. 2A) to two partially exploded states (e.g., FIGS. 2B-C). FIGS. 3A-C provide cross-sectional side views of an example atomizer cartridge assembly 300 that, similarly, progress from showing a fully assembled state (e.g., FIG. 3A) to showing two partially exploded states (e.g., FIGS. 3B-C). FIGS. 4A-C provide side views of an example atomizer cartridge assembly 400 in the same pattern. In some embodiments, one or more of the example atomizer cartridge assemblies 200, 300, and 400 can be the same or similar. In some embodiments, all three of the example atomizer cartridge assemblies 200, 300, 400 that are depicted in FIGS. 2A-4C can be the same. Accordingly, it is appreciated that a description made with reference to a given component/reference numeral can apply to one or more (or all) of the corresponding components/reference numerals in the remaining figures. For example, the description made regarding the upper assembly 210 of FIGS. 2A-C can, in some embodiments, apply equally to the upper assembly 310 of FIGS. 3A-C and/or the upper assembly 410 of FIGS. 4A-C, etc.

Note that reference may also be made to FIG. 6, which illustrates a detailed exploded perspective view of an example atomizer cartridge assembly 600 according to aspects of the present disclosure (which in some embodiments can be the same as or similar to one or more of the example atomizer cartridge assemblies 100, 200, 300, 400, and/or 500).

As mentioned previously, the atomizer cartridge assembly described herein can comprise an upper assembly that is integrally molded in a single-piece construction to comprise a mouthpiece, a fluid reservoir, and a vapor channel. For example, in the cross-sectional views of FIGS. 3B and 3C, upper assembly 310 can be seen separate from lower assembly 360. As illustrated, upper assembly 310 can be a single, continuous material formed into a concave, dome, or tapered shape towards an upper distal end of the upper assembly 310. Towards the opposite (e.g., lower) distal end, upper assembly 310 can have an approximately cylindrical shape that is sized for engagement with a corresponding portion of the lower assembly 360. For example, FIGS. 2A-C depict the upper assembly 210 as including a mouthpiece housing 212 with a domed outer wall that tapers radially inwards as it extends away from the approximately cylindrical distal end portion of upper assembly 210 (e.g., tapers radially inwards as it extends towards the proximal end portion of upper assembly 210). In some embodiments, the outer wall of mouthpiece housing 212 can be used to provide a mouthpiece of atomizer cartridge assembly 200, e.g., wherein the outer wall of mouthpiece housing 212 is placed in a user's mouth or brought into contact with the user's lips to allow the user to inhale the vapor produced by the atomizer cartridge assembly 200.

As contemplated herein, the distal end portion of upper assembly 210 can be the bottom portion of upper assembly 210 when the upper assembly 210 is oriented as shown in the examples of FIGS. 2A-C. In other words, the distal end portion of upper assembly 210 can be the portion of upper assembly 210 that is nearest to lower assembly 260 when the atomizer cartridge assembly 200 is in an assembled state. The proximal end portion of upper assembly 210 can be opposite from the distal end portion (e.g., the proximal end portion can be the top portion of upper assembly 210 when in the orientation shown in the examples of FIGS. 2A-C). As illustrated, a vapor outlet 228 can be located at the proximal end portion of upper assembly 210.

In some embodiments, a binding ring 350 can be provided in a compressive engagement about an outer surface of the approximately cylindrical lower distal end of upper assembly 310. For example, binding ring 350 can apply a radially compressive force to the outer surface of the approximately cylindrical lower distal end of upper assembly 310 when upper assembly 310 has been press-fit or otherwise installed onto lower assembly 360. Binding ring 350 can comprise a different material than the material utilized by one or more of the upper assembly 310 and the lower assembly 360. For example, in some embodiments, upper assembly 310 and/or lower assembly 360 can be injection molded and/or can be formed from one or more plastics, polymers, etc., and binding ring 350 can be formed from one or more metals. In some examples binding ring 350 can be thinner (e.g., having a smaller cross-sectional width) than the outer wall of upper assembly 310 about which binding ring 350 is installed. In some examples, and as illustrated in FIGS. 2A-3C, upper assembly 310, and binding ring 350 can be sized such that the outer surface of binding ring 350 is flush with the outer surface of upper assembly 310 when installed onto the assembled atomizer cartridge assembly 300. Binding ring 350 can additionally, or alternatively, be sized such that the outer surface of binding ring 350 is flush with the outer surface of lower assembly 360 when installed onto the assembled atomizer cartridge assembly 300.

In some examples, the radially compressive force applied by binding ring 350 can be a sealing force that augments or otherwise works in cooperation with a press-fit or another type of attachment between upper assembly 310 and lower assembly 360. For example, as mentioned above, upper assembly 310 and/or lower assembly 360 can be formed from one or more plastics, polymers, etc., in which case a press-fit between the two assemblies can cause plastic (e.g., permanent) deformation at or about the location of the press-fit interface. This plastic deformation can enhance the binding strength of the press-fit, such that in some embodiments, the upper assembly 310 cannot be manually separated from the lower assembly 360. However, the plastic deformation resulting from the press-fit between upper assembly 310 and lower assembly 360 can also result in cracking or other damage, which can be cosmetic and/or structural. In some cases, cracking can result from the plastic-on-plastic press-fit interface that results when upper assembly 310 and lower assembly 360 are formed from the same or like materials. For example, the press-fit can cause cracks to appear on the outer surface of the approximately cylindrical lower distal end of upper assembly 310. As such, binding ring 350 can be provided to contain and/or reinforce any cracks or other deformations that appear on upper assembly 310 when it is press-fit to lower assembly 360. In some embodiments, one or more sealing gaskets (e.g., such as the sealing gaskets 652 depicted in FIGS. 6A-B) can be included to provide a sealing force between upper assembly 310 and lower assembly 360. For example, the sealing gaskets 652 can include but are not limited to, O-rings formed from a rubber, plastic, polymer, etc., material, wherein a press-fit attachment between upper assembly 310 and lower assembly 360 compresses the sealing gaskets 652 into a corresponding receiving groove or channel on the outer surface of lower assembly 360.

In addition to forming a mouthpiece for vapor inhalation, it is further contemplated that the single-piece construction of the atomizer cartridge assembly described herein can also form an integral fluid reservoir for storing and providing a fluid, oil, or other liquid (collectively referred to herein as a "fluid") to one or more heating elements located within the lower assembly of the atomizer cartridge. For example, returning to the cross-sectional views of FIGS. 3A-C, an internal fluid reservoir 314 can be provided as the empty volume between the outer wall of mouthpiece housing 312 and vapor channel 316 of the upper assembly 310. In some embodiments, the fluid reservoir 314 can comprise the empty volume given by the radial extent between the outer surface of vapor channel 316 and the inner surface of mouthpiece housing 312. In other words, the fluid reservoir 314 is seen in the cross-sectional view of FIGS. 3A-C can be provided as a single continuous volume located within upper assembly 310 and surrounding the central longitudinal vapor channel 316.

Figure 5:
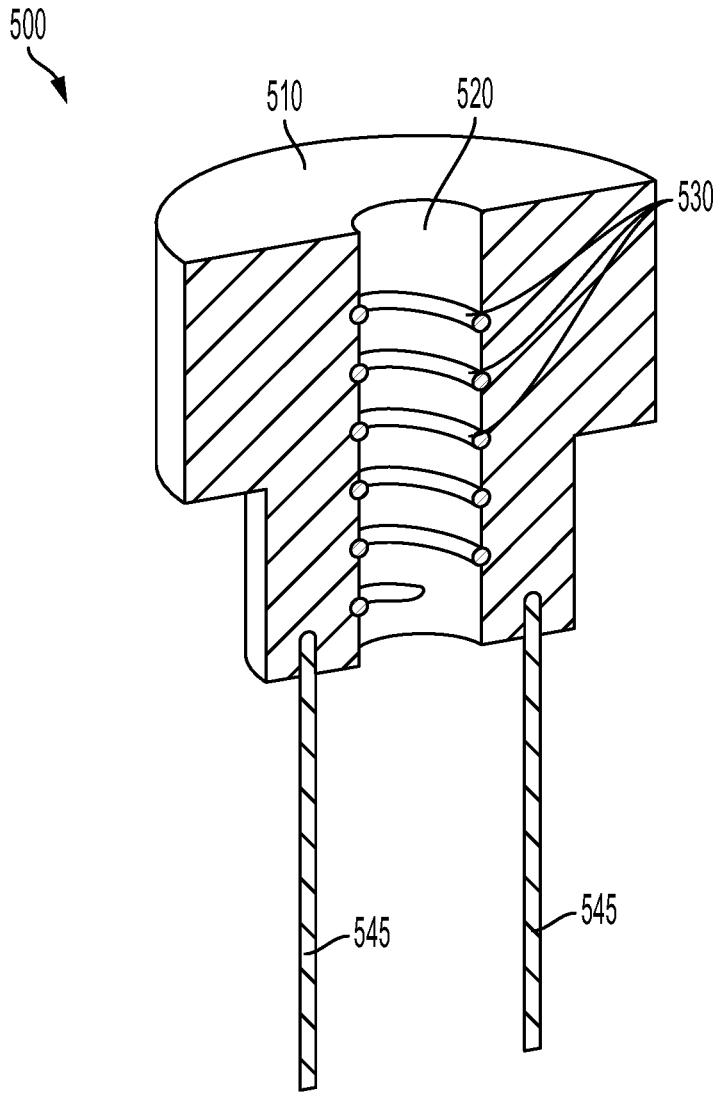
FIG. 5 illustrates a perspective cross-sectional view of an example atomizer.

In some embodiments, fluid reservoir 314 can be at least partially open at its lower end, e.g., to permit filling of fluid reservoir 314 and/or to convey fluid from fluid reservoir 314 to a heating element located in the lower assembly 360 (e.g., such as the heating element 530 of atomizer 500 shown in FIG. 5). In use, fluid reservoir 314 can be isolated or otherwise sealed to prevent leaking or undesired discharge of any fluids it may contain. Accordingly, the fluid stored within fluid reservoir 314 can surround vapor channel 316 while being prevented from entering vapor channel 316 directly. For example, as will be explained in greater depth below, fluid can flow downward (e.g., out of fluid reservoir 314 of upper assembly 310) to an atomizer 340 located in lower assembly 360 (e.g., via the one or more fluid transfer openings 232 shown in FIGS. 2B-C), where the fluid can then be vaporized and drawn back upward into the central longitudinal vapor channel 316.

For instance, the fluid flow from reservoir 314 to atomizer 340 can be driven by gravity when the cartridge assembly 300 is in a substantially upright orientation (e.g., such as that depicted in FIGS. 3A-C). In one illustrative example, gravitational forces can cause fluid to be fed from the fluid reservoir 314 to one or more absorbent pads 342 disposed between fluid reservoir 314 and atomizer 340. Upon the fluid interacting with or otherwise being absorbed by the one or more absorbent pads 342, capillary and/or wicking forces can convey the absorbed fluid from the one or more absorbent pads 342 to atomizer 340, as will be described in greater depth below. In some examples, although not depicted in FIGS. 3A-C, one or more absorbent pads can additionally be provided between the atomizer 340 and the base portion 362. The one or more additional absorbent pads can be the same as or similar to the absorbent pads 342. For example, the additional absorbent pads can comprise a plurality of absorbent pads (e.g., such as the absorbent pads 342) arranged in a stack or layer that at least partially occupies the volume between the atomizer 340 and the base portion 362. In some cases, the additional absorbent pads can be of a same or similar thickness to that of the absorbent pads 342, with a smaller length and/or width than that of the absorbent pads 342. For example, the additional absorbent pads can be sized to fit within the volume between atomizer 340 and base portion 362.

Accordingly, in some embodiments, a vapor inlet 318 can be provided at the open distal end of vapor channel 316 for receiving vaporized fluid from atomizer 340. The open distal end of vapor channel 316 can be the open end of vapor channel 316 that is opposite from the vapor outlet 328 (e.g., opposite from the vapor outlet 328 that is located at the proximal end of upper assembly 310). For example, vapor inlet 318 can attach to a vapor distribution opening 368 extending from the upper surface of lower assembly 360, such that vapor inlet 318 couples the vapor distribution opening 368 to the central longitudinal vapor channel 316. Vapor distribution opening 368 can be located along the central longitudinal axis of lower assembly 360, which in some cases can be the same as the central longitudinal axis of upper assembly 310 and/or the same as the central longitudinal axis about which vapor channel 316 is disposed within the upper assembly 310.

In operation, fluid from the fluid reservoir 314 can be vaporized by atomizer 340 (e.g., using a heating element such as the heating element 530 of FIG. 5). Vapor produced by atomizer 340 can be conveyed to the vapor channel 316 via the coupling between the vapor distribution opening 368 and the vapor inlet 318. From this coupling point, vapor enters and flows along the longitudinal length of vapor channel 316 before ultimately exiting both the vapor channel 316 and the atomizer cartridge 300. As illustrated, in order for vaporized fluid to exit the vapor channel 316, the upper assembly 310 of atomizer cartridge 300 can include at least one vapor outlet 328 for communicating vapor to a user of the atomizer cartridge assembly.

For example, FIGS. 2A-C depict a vapor outlet 228 integrally formed with an outer wall of mouthpiece housing 212 of the upper assembly 210. In some embodiments, vapor outlet 228 can comprise an aperture or other opening that extends through the otherwise closed surface of the outer wall of mouthpiece housing 212 of upper assembly 210. As illustrated, vapor outlet 228 can be circular in shape and symmetrically aligned with respect to the central longitudinal axis of upper assembly 210 and/or atomizer cartridge assembly 200, although other shapes, geometries, and/or alignments can also be utilized without departing from the scope of the present disclosure. For example, the vapor outlet 228 can have a size and shape that are chosen to match the size and shape of the vapor channel located within the upper assembly 210 (e.g., the vapor outlet 228 can have a circular shape corresponding to the cylindrical shape of the vapor channel 316). In some embodiments, the vapor outlet 228 can comprise an open upper end of the vapor channel 316.

For example, the vapor outlet 328 is seen in the cross-sectional view of FIGS. 3A-C can comprise an open upper end of a longitudinally oriented vapor channel 316, such that vapor outlet 328 and vapor channel 316 have the same (or a substantially similar) size and shape. As illustrated, vapor channel 316 can connect the vapor outlet 328 (e.g., located at an upper distal end of the vapor channel 316) to a vapor inlet 318. Vapor inlet 318 can be provided as an aperture or opening located at a lower distal end of vapor channel 316. In operation, vaporized fluid can enter vapor channel 316 via the vapor inlet 318, flow through the vapor channel 316, and exit through the vapor outlet 328.

An open distal end of fluid reservoir 314 may be coplanar with a vapor inlet 318 located at the open distal end of vapor channel 316, as illustrated in FIG. 3B. Although not shown, in some embodiments the open distal end of fluid reservoir 314 can be ring-shaped, e.g., provided as the open annular space surrounding the circular vapor inlet 318 and/or the central longitudinal vapor channel 316. In some embodiments, the annular distal opening of fluid reservoir 314 can have a size corresponding to an annular upper surface of lower assembly 260, 360 (e.g., the annular or ring-shaped surface shown in FIGS. 2B-C as including a plurality of fluid transfer openings 232).

For example, with reference to FIGS. 2B-C, when upper assembly 210 is attached to lower assembly 260, the annular open distal end of fluid reservoir 314 can be brought into contact with and sealed by the annular upper surface of lower assembly 260 upon which the plurality of fluid transfer openings 232 are disposed. In other words, the open annular distal end of fluid reservoir 314 can have a maximum radial width or diameter that is less than a maximum radial width or diameter of the annular upper surface of lower assembly 360 (e.g., the surface upon which the open distal end of fluid reservoir 314 is seated). In this manner, the open annular distal end of fluid reservoir 314 can be sealed to prevent any fluid leakage or fluid movement out of fluid reservoir 314, other than through the plurality of fluid transfer openings 232 defined on the annular upper surface of lower assembly 260/360.

As illustrated, the plurality of fluid transfer openings 232 can include six circular openings arranged on the upper surface of lower assembly 260, although a greater or lesser number of fluid transfer openings 232 may also be utilized without departing from the scope of the present disclosure. For example, in some embodiments the plurality of fluid transfer openings 232 can comprise five circular openings. In some examples, the plurality of fluid transfer openings 232 can include four circular openings. In some cases, the fluid transfer openings 232 can be provided as two or more slots or rectangular openings, etc. It is further noted that the plurality of fluid transfer openings 232 can be arranged symmetrically or asymmetrically on the upper surface of lower assembly 260. Similarly, one or more different shapes, sizes, and/or geometries, etc., can be utilized by one or more of the plurality of fluid transfer openings 232 without departing from the scope of the present disclosure. In some embodiments, each of the plurality of fluid transfer openings 232 can have a same diameter. In some cases, the size or diameter of the plurality of fluid transfer openings 232 can be based on characteristics of the fluid or oil that may be used (e.g., viscosity) and/or desired fluid handling and delivery with respect to the atomizer. For example, a larger diameter can be used for one or more of the fluid transfer openings 232 when a relatively high viscosity fluid will be used and/or when a relatively high fluid flow rate through the fluid transfer openings 232 is desired. Similarly, a smaller diameter can be used for one or more of the fluid transfer openings 232 when a relatively low viscosity fluid will be used and/or when a relatively low fluid flow rate through the fluid transfer openings 232 is desired.

In some embodiments, a total open surface area can be distributed across the plurality of fluid transfer openings 232, either symmetrically or asymmetrically. For example, the plurality of fluid transfer openings 232 can each have a size or surface area (e.g., based on each opening diameter) and be provided in sufficient quantity to provide a total surface contact area of a given value. For example, a total surface contact area of 12.6 $mm^2$ can be achieved by using four fluid transfer openings 232 that are each circles having a diameter of 2 mm. The same total surface contact area of 12.6 $mm^2$ can also be achieved by using six fluid transfer openings 232 that are each circles having a diameter of approximately 1.6 mm.

In some examples, the total surface contact area can be between 1 $mm^2$ and 15 $mm^2$. For example, in some embodiments a total surface contact area of 1 $mm^2$ can be provided by using two fluid transfer openings 232 that are each circles having a diameter of 1 mm. As mentioned previously, the total surface contact area provided by the plurality of fluid transfer openings 232 and/or the quantity of the plurality of fluid transfer openings 232 can be based at least in part on a viscosity of a fluid that will be used in the atomizer assembly 200 or stored in fluid reservoir 214. For example, for a high viscosity (and/or high purity) fluid or oil, the plurality of fluid transfer openings 232 may comprise a total of four fluid transfer openings that are each circles having a diameter of 2 mm. In another example, for a lower viscosity (and/or lower purity) fluid or oil, the plurality of fluid transfer openings 232 may comprise a total of two fluid transfer openings that are each circles having a diameter of 1 mm. In some embodiments, the plurality of fluid transfer openings 232 can comprise a total of six fluid transfer openings that provide a total surface contact area of approximately 15 $mm^2$.

In some examples, the plurality of fluid transfer openings 232 can be configured based on viscosity and/or other material properties of a fluid that will be stored in fluid reservoir 314. In some cases, the plurality of fluid transfer openings 232 can be configured based on a type of fluid that may be stored in fluid reservoir 314. For example, as illustrated in FIGS. 2B and 2C, the plurality of fluid transfer openings 232 can include a chamfered or beveled edge on their upper surface (e.g., the upper surface where fluid first passes from fluid reservoir 314 and into the fluid transfer openings 232). In some embodiments, a chamfered edge can be provided on the plurality of fluid transfer openings 232 based at least in part on an expectation that a high-viscosity fluid will be stored in fluid reservoir 314, and therefore that the high-viscosity fluid will be conveyed through the fluid transfer openings 232. In some embodiments, the inclusion of chamfered and/or beveled edges on the plurality of fluid transfer openings 232 can improve the flow characteristics of fluids that are conveyed from fluid reservoir 314 and through the plurality of fluid transfer openings 232. For example, high viscosity fluids such as oils may exhibit poor flow characteristics when the fluid transfer openings 232 are provided with a 90-degree edge (e.g., in the absence of a chamfered or beveled edge).

Figure 6A:
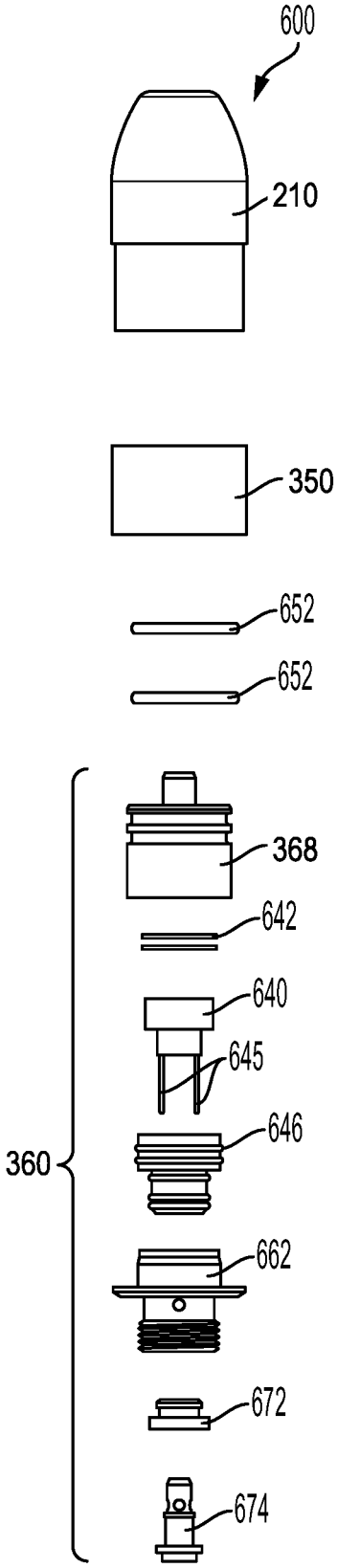
FIG. 6A illustrates an exploded side view of example components of an atomizer cartridge assembly that can include one or more of the example atomizer cartridge assemblies of FIGS. 1-4C.
Figure 6B:
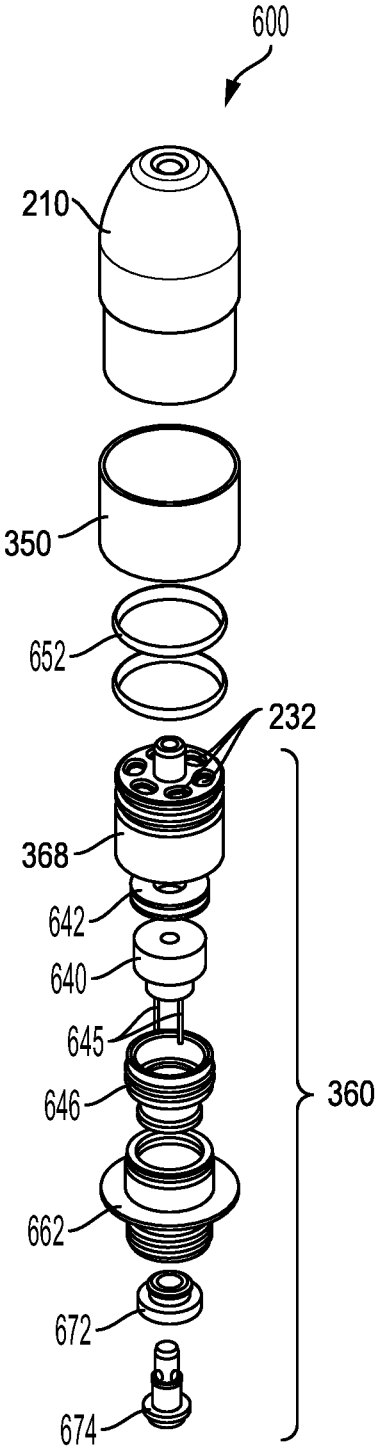
FIG. 6B illustrates an exploded perspective view of the example atomizer cartridge assembly of FIG. 6A.

Fluid can be conveyed from fluid reservoir 314 to an atomizer 340 via one or more of the plurality of fluid transfer openings 232. As illustrated, atomizer 340 can be contained within the lower assembly 360. In some embodiments, the atomizer 340 can be the same as or otherwise similar to the example atomizer 500 depicted in FIG. 5 (as will be discussed in greater depth below). One or more fluid absorbent pads 342 can be included in lower assembly 360, for example provided between an upper surface of atomizer 340 and a lower surface of the plurality of fluid transfer openings 232. In some embodiments, at least two fluid absorbent pads 342 can be provided to absorb fluid from fluid reservoir 314 and transfer the absorbed fluid to atomizer 340. For example, FIGS. 6A and 6B illustrate a pair of absorbent pads 642, which in some embodiments can be the same as or similar to the absorbent pads 342.

The absorbent pads 342 can sit on or otherwise make contact with an upper surface of the atomizer 340, such that the absorbent pads 342 can convey fluid to atomizer 340 based at least in part on this contact area. In some examples, the absorbent pads 342 can store (e.g., absorb) a volume of fluid that depends at least in part on factors such as the total surface area provided by the absorbent pads 342, the total thickness of the absorbent pads 342, etc. As illustrated, the absorbent pads 342, 642 can be circular or ring-shaped, with a central hole that is aligned with one or more of the central longitudinal vapor channel 316 of the upper assembly 310 and/or a central longitudinal channel of the atomizer 340.

In some embodiments, the absorbent pads 342 can comprise one or more wicking materials for conveying fluid from the fluid reservoir 314 to the atomizer 340. For example, absorbent pads 342 can be an organic material, such as cotton, cellulose, etc., although it is noted that various other wicking materials can also be utilized in the absorbent pads 342 without departing from the scope of the present disclosure. By providing the absorbent pads 342 as wicking material(s), fluid can be conveyed from fluid reservoir 314 to atomizer 340 even if (or when) gravity alone is insufficient to cause the desired fluid movement. For example, absorbent pads 342 can cause the transfer of fluid to atomizer 340 via wicking action if the atomizer assembly 300 is inverted or held at an angle, if the fluid stored in reservoir 314 is a relatively high viscosity, etc. In some cases, the absorbent pads 342 can be provided to accelerate the movement or transfer of high viscosity fluids from reservoir 314 to atomizer 340. High viscosity fluids can include but are not limited to, oils, concentrates, etc., and/or fluids with an increased viscosity due to a lower temperature.

In some examples, although not illustrated, one or more absorbent pads can additionally be provided between the atomizer 340 and the base portion 362. The one or more additional absorbent pads can be the same as or similar to the absorbent pads 342 and/or the absorbent pads 642. For example, the one or more additional absorbent pads comprise the same one or more wicking materials as the absorbent pads 342 and/or 642. In some cases, the additional absorbent pads can comprise a plurality of absorbent pads (e.g., such as the absorbent pads 342, 642) arranged in a stack or layer that at least partially occupies the volume between the atomizer 340 and the base portion 362. In some cases, the additional absorbent pads can be of a same or similar thickness to that of the absorbent pads 342,642 with a smaller length and/or width than that of the absorbent pads 342,642. For example, the additional absorbent pads can be sized to fit within the volume between atomizer 340 and base portion 362.

In some examples, atomizer 340 (and/or atomizer 500) can comprise a ceramic material. In some embodiments, the ceramic material can itself absorb and/or store fluid, such as the fluid(s) that may be contained in fluid reservoir 314. Although the ceramic material of atomizer 340 can absorb fluid directly, in some embodiments absorbent pads 342 can be provided between atomizer 340 and the fluid reservoir 314 to increase or otherwise enhance the efficacy of fluid absorption/conveyance into the ceramic material of atomizer 340. For example, the ceramic material of atomizer 340 can have a smaller total surface area for fluid absorption in comparison to that of the absorbent pads 342, in which case the use of absorbent pads 342 allows a greater volume of fluid to be conveyed into the ceramic material of atomizer 340. In some cases, the ceramic material of atomizer 340 may dry out too quickly in the absence of the absorbent pads 342, either from an evaporative drying and/or as fluid is consumed from the ceramic material of atomizer 340 and vaporized. As such, the fibrous material of the absorbent pads 342 can provide a consistent and reliable conduit for fluid to travel from the fluid reservoir 314 to the atomizer 340, whereupon the fluid can become embedded in the ceramic material of atomizer 340 until the embedded fluid is subsequently vaporized.

FIG. 5 illustrates a cross-sectional view of an example atomizer 500, which in some embodiments can be the same as or similar to the atomizer 340 discussed above. For example, atomizer 500 can comprise a ceramic material that absorbs and stores fluid prior to the fluid being vaporized by a heating element 530 of atomizer 500. In some embodiments, atomizer 500 can be a ceramic material with a porosity between 60-70%, although other porosity values and/or ceramic materials can also be utilized without departing from the scope of the present disclosure. In some examples, atomizer 500 can comprise a ceramic material with a higher porosity (e.g., 70-80%). A higher porosity ceramic material can be associated with an improved taste or flavor of vapor produced by atomizer 500; however, a higher porosity ceramic material can also be associated with increased fragility and/or decreased manufacturing and assembly yield(s). In some embodiments, atomizer 500 can comprise a ceramic material having a porosity between 45-65%, with such porosity values providing a balance between manufacturability and vapor taste, although it is again noted that other porosity values and/or ceramic materials can be utilized without departing from the scope of the present disclosure.

In some embodiments, the ceramic material of atomizer 500 can itself act as a fluid reservoir, e.g., in addition to or separate from the dedicated fluid reservoir 314 of the upper assembly 310. In some examples, the ceramic material of atomizer 500 can store a volume of fluid sufficient to 'feed' or otherwise maintain a steady fluid supply to a heating element 530 for one or more vaporization cycles. In other words, the ceramic material of atomizer 500 can be sized to store/absorb a volume of fluid that is sufficient for heating element 530 to produce vapor for at least one full inhalation by a user of the presently disclosed atomizer cartridge(s). Accordingly, in some embodiments it is contemplated that atomizer 500 can be provided in various geometric shapes and configurations other than the multi-diameter stepped cylindrical shape(s) illustrated herein, without departing from the scope of the present disclosure. In some examples, atomizer 500 can be provided with a flanged or plug-like cylindrical shape, without departing from the scope of the present disclosure.

In some examples, atomizer 500 can be provided with a different geometric shape, configuration, etc., having a substantially same or similar total volume (e.g., fluid absorption capacity) as the multi-diameter stepped cylindrical atomizer(s) 340, 500, 640 illustrated in FIGS. 3A-C, FIG. 5 and FIGS. 6A-B, respectively. For example, one or more of the atomizers 340, 500, 640 could be provided with a constant cylindrical diameter, a continuously changing or tapering diameter, a conical shape, etc. In some embodiments, an internal diameter of atomizer vapor channel 520 (e.g., the channel running along the central longitudinal axis of atomizer 500) can be variable along its longitudinal length. For instance, the internal diameter of atomizer vapor channel 520 can vary with an outer diameter of atomizer 500, although it is also possible for the internal diameter of atomizer vapor channel 520 to vary independently from the outer diameter (or any other dimension) of atomizer 500.

As illustrated, atomizer 500 includes an upper surface 510, which can be brought into contact with one or more absorbent pads, such as the absorbent pads 342 of FIGS. 3A-C and/or the absorbent pads 642 of FIGS. 6A-B. As described previously, the absorbent pads can be used to convey fluid from fluid reservoir 314 to atomizer 500. In some examples, fluid can be initially absorbed into the upper surface 510 of atomizer 500 and subsequently distributed throughout the interior of the ceramic material of atomizer 500 (e.g., the absorbent pads 342, 642 can be placed in contact with only the upper surface 510 of the atomizer 500). In embodiments in which the ceramic material of atomizer 500 stores enough fluid to produce vapor for multiple full inhalations by a user, the absorbent pads 342, 642 can be provided with a relatively small size and/or total absorptive volume—e.g., the absorbent pads can be sized to maintain a constant fluid supply to 'recharge' or 'feed' the ceramic core of atomizer 500, even if the absorbent pads themselves do not store enough fluid to produce vapor for a full inhalation. As mentioned previously, in some examples one or more additional absorbent pads can be provided about the outer surface of atomizer 500. For example, one or more additional absorbent pads can be provided between the two electrical leads 545 extending from the distal end of the atomizer 500, such that at least a portion of the additional absorbent pad material makes contact with the distal end of the atomizer 500 (e.g., the distal end of atomizer 500 to which the electrical leads 545 are coupled). In one illustrative example, the one or more additional absorbent pads can comprise a same or similar wicking material as the absorbent pads 342 and/or the absorbent pads 642. It is further noted that description made with reference to one or more of the absorbent pads 342 and/or 642 can, in some embodiments, be likewise applied to the one or more additional absorbent pads.

As illustrated, heating element 530 can be provided in or about the circumference of a central vapor channel 520 of the atomizer 500 (e.g., also referred to herein as "atomizer vapor channel" 520). In some embodiments, the central vapor channel 520 of atomizer 500 can be parallel to and/or aligned with the central longitudinal vapor channel 316 provided in upper assembly 310 of the atomizer cartridge assembly 300. For example, in an assembled state of atomizer cartridge assembly 300 (e.g., when upper assembly 310 is coupled to lower assembly 360), a same or similar atomizer vapor channel located in atomizer 340 can be brought into alignment with the corresponding vapor channel 316 of upper assembly 310 to thereby form a continuous longitudinal vapor channel extending along the longitudinal length of the atomizer cartridge assembly 300.

Heating element 530 can be provided as one or more resistive heating elements, e.g., which generate heat in response to the application of electrical power. In some embodiments, atomizer 500 can include electrical leads 545 for coupling electrical power to heating element 530. The electrical leads 545 can receive electrical power from one or more internal power sources and/or external power sources. For example, an internal power source can be provided by one or more batteries included in the atomizer cartridge assembly described herein (e.g., an internal battery included in atomizer cartridge assembly 300). In some examples, the electrical leads 545 can receive electrical power from an external power source, such as a battery included in an electronic cigarette body, vaporizer body, or other body components to which the cartridge assembly described herein (such as atomizer cartridge assembly 300) can be attached to for use.

For example, FIGS. 6A-B depict an atomizer 640 that can, in some embodiments, be the same as or similar to atomizer 500. Atomizer 640 is illustrated as including a pair of electrical leads 645, which can be the same as or similar to electrical leads 545. In some embodiments, an atomizer support structure 646 can provided to receive atomizer 645 and/or the electrical leads 645. For example, the atomizer support structure 646 can be sized to enclose atomizer 645, either in whole or in part, within a corresponding receiving volume located within an interior of atomizer support structure 646.

In some embodiments, the atomizer support structure 646 can be received within a threaded base 662, as is also illustrated in FIGS. 6A-B. For example, atomizer support structure 646 can be attached to threaded base 662 via a press-fit, an internally threaded engagement, etc. The threaded base 662 can include an externally threaded portion, shown here as being provided at a distal lower end of the threaded base 662. In some embodiments, the threaded base 662 can be the same as or similar to one or more of the threaded base portions 162, 262, 362, and/or 462 (e.g., depicted in FIGS. 1, 2A-C, 3A-C, and 4A-C, respectively). As described previously, a threaded base portion such as threaded base 662 can be used to removably couple the atomizer cartridge assembly described herein to an electronic cigarette or other vaporizer body. Accordingly, in some examples threaded base 662 can include one or more battery leads (not depicted) for electrically coupling the electrical leads 645 of atomizer 640 to a battery or other power source provided by an electronic cigarette or other vaporizer body to which the threaded base 662 is attached. For instance, an interior of threaded base 662 can include one or more battery leads to electrically couple electrical leads 645 of atomizer 640 to a battery located within an electronic cigarette or vaporizer body.

Returning to the example atomizer 500 depicted in FIG. 5 (which can be the same as or similar to the example atomizer 340 of FIGS. 3A-C and/or can be the same as or similar to the example atomizer 640 of FIGS. 6A-B), as illustrated, the electrical leads 545 can be electrically coupled to heating element 530 through an interior or core portion of atomizer 500. For example, where atomizer 500 comprises a ceramic material, at least a portion of electrical leads 545 and/or heating element 530 can be embedded in the ceramic material of atomizer 500. As mentioned above, heating element 530 can be provided as a resistive heating element, which can include (but is not limited to) one or more wires.

As illustrated, heating element 530 can comprise a continuous, spiral length of wire provided about or along an inner surface of the atomizer vapor channel 520. For example, in some embodiments heating element 530 can include a spiral length of wire that is at least partially embedded in the inner surface of atomizer vapor channel 520. In some cases, atomizer 500 can be provided as a ceramic material wherein heating element 530 is partially embedded in the ceramic material of the inner surface of atomizer vapor channel 520. In some embodiments, heating element 530 can be installed or otherwise integrated into the ceramic material of atomizer 500 during the manufacture of atomizer 500 and/or during the manufacture or creation of atomizer vapor channel 520.

In some embodiments, heating element 530 can make contact with the inner surface of atomizer vapor channel 520 without being embedded (either partially or wholly) in the material of the inner surface of atomizer vapor channel 520. For example, heating element 530 can be provided as a spiral length of wire having an outer diameter approximately equal to or slightly greater than an inner diameter of atomizer vapor channel 520. When the outer diameter of the heating element 530 is greater than the inner diameter of atomizer vapor channel 520, a radially compressive force can be applied to install heating element 530 into atomizer vapor channel 520, with the same radially compressive force subsequently holding the heating element 530 in place within atomizer vapor channel 520. As illustrated, heating element 530 can include a spiral length of wire running approximately perpendicular to the central longitudinal axis of atomizer 500 and atomizer vapor channel 520. When heating element 530 is provided as one or more lengths of resistive heating wires, heating element 530 can be provided to spiral in either a clockwise or counterclockwise fashion within atomizer vapor channel 520.

In some embodiments, heating element 530 can additionally (or alternatively) include one or more lengths of resistive heating wire that run substantially parallel to the central longitudinal axis of atomizer vapor channel 520, without departing from the scope of the present disclosure. In some embodiments, heating element 530 can include one or more lengths of resistive heating wire having a constant cross-sectional shape, area, diameter, etc., along its length. In some embodiments, heating element 530 can include one or more lengths of resistive heating wire having a variable cross-sectional shape, area, diameter, etc., along one or more portions of its overall length. For example, heating element 530 can be thicker or have a larger diameter towards the upper end of atomizer vapor channel 520 (e.g., towards upper surface 510) and can be thinner or have a smaller diameter towards the lower end of atomizer vapor channel 520 (e.g., towards electrical leads 545), and vice versa.

As described previously, in some examples atomizer 500 can be provided with various different geometric shapes, configurations, etc., having a substantially same or similar total volume (e.g., fluid absorption capacity) as the multi-diameter stepped cylindrical atomizer(s) 340, 500, 640 illustrated in FIGS. 3A-C, FIG. 5 and FIGS. 6A-B, respectively. For example, atomizer 500 could be provided with a constant cylindrical diameter, a continuously changing or tapering diameter, a conical shape, etc. In some embodiments, one or more of the atomizer vapor channel 520 and/or the heating element 530 can be provided based on the shape or geometric profile of the ceramic core of atomizer 500. For example, atomizer vapor channel 520 and/or heating element 530 can be designed such that the heating element 530 is located near the center of mass of the ceramic core of atomizer 500, in order to promote a more even vaporization of fluid that becomes embedded or otherwise absorbed within the ceramic material of atomizer 500.

By providing heating element 530 at or near the center of mass of the ceramic core of atomizer 500, fluid embedded within the ceramic material can be drawn more evenly towards the inner surface of atomizer vapor channel 520 (e.g., because heating element 530 vaporizes fluid near the inner surface of atomizer vapor channel 520). In some examples, by providing heating element 530 at or near the center of mass of the ceramic core of atomizer 500, embedded or absorbed fluid within the ceramic core of atomizer 500 can be consumed (e.g., vaporized) by heating element 530 in an approximately radially symmetric fashion. The radially symmetric consumption of fluid from the ceramic core of atomizer 500 by heating element 530 can help avoid or otherwise minimize the presence of 'dead spots.' For example, dead spots can occur where fluid stagnates within the ceramic material of atomizer 500 rather than flowing to the inner surface of atomizer vapor channel 520 where the fluid can be consumed and vaporized by heating element 530 (e.g., the consumption of fluid from the ceramic material of atomizer 500 causes fresh fluid to be drawn into the ceramic material, whereupon the cycle of fluid consumption/vaporization by heating element 530 can repeat). In some embodiments, the ceramic core of atomizer 500, the atomizer vapor channel 520, and/or the heating element 530 can be designed to avoid stagnation spots by causing heating element 530 to consume and vaporize fluid in an approximately first-in-first-out fashion, wherein fluid is vaporized by heating element 530 in approximately the order in which the fluid was absorbed into the ceramic core of atomizer 500.

As described above, in some embodiments an atomizer support structure can be provided to receive or seat the atomizer within the atomizer cartridge assembly disclosed herein. For example, FIGS. 6A-B depict an example atomizer cartridge assembly 600 including an atomizer 640 and an atomizer support structure 646. Atomizer 640 can be installed within atomizer support structure 646, and the atomizer support structure 646 can be coupled to or seated within threaded base 662. In some examples, atomizer support structure 646 can include one or more O-rings, gaskets or other sealing members for coupling to threaded base 662 via a press fit, although it is appreciated that other attachment mechanisms may also be utilized without departing from the scope of the present disclosure.

FIGS. 6A-B additionally depict an air inlet plug 672 and an air inlet regulator 674, which can be installed in an open distal end of threaded base 662 (e.g., in the orientation shown in FIGS. 6A-B, the open bottom end of threaded base 662). Air inlet regulator 674 can include one or more air inlet holes or openings, which in some examples can be brought into alignment with one or more corresponding holes or openings disposed on an outer surface of threaded base 662, as can be seen in FIGS. 6A-B. For example, air inlet regulator 674 (and therefore, threaded base 662) can include four symmetrically arranged air inlet holes or openings, although different quantities, sizes, and/or shapes of the air inlet holes or openings can be utilized without departing from the scope of the present disclosure.

As illustrated, air inlet plug 672 can have a maximum outer diameter that is greater than a maximum outer diameter of air inlet regulator 674. In some examples, the outer diameter of air inlet plug 672 can be selected to adapt the outer diameter of air inlet regulator 674 to the relatively larger internal diameter of threaded base 662, e.g., such that air inlet regulator 674 when installed into air inlet plug 672 forms a seal against the inner surface of threaded base 662. In some embodiments, the seal formed between the inner surface of threaded base 662 and air inlet plug 672 can form a fluid trap within threaded base 662, which can catch any excess fluid that may drip from or otherwise be exuded by the ceramic material of the atomizer 640. For example, when air inlet plug 672 and air inlet regulator 674 are installed into the threaded base 662, a fluid trap volume can be defined along the longitudinal distance running from a lower-most extent given by the flanged base of air inlet plug 672 to an upper-most extent given by the air inlet holes or openings of air inlet regulator 674.

In operation, air inlet regulator 674 can include air inlet holes or openings that permit atmospheric or environmental air (e.g., from the ambient environment surrounding atomizer cartridge assembly 600) to enter the atomizer cartridge assembly 600 and carry away vapor produced by atomizer 640. For example, when a user inhales from the atomizer cartridge assembly 600, a volume of ambient air approximately equal to the volume of the user's inhalation can enter atomizer cartridge assembly via the air inlet holes or opening of air inlet regulator 674. In some embodiments, the quantity, size and/or diameter of the air inlet holes/or openings provided on air inlet regulator 674 can be restricted such that, when a user inhales from atomizer cartridge assembly 600, a pressure differential is created or otherwise maintained between the ambient atmosphere and the internal volume of atomizer cartridge assembly 600.

In some examples, a volumetric flow rate of ambient air through the air inlet regulator 674 during use of the atomizer cartridge assembly 600 can be chosen to improve the taste or flavor of the vaporized fluid produced by atomizer cartridge assembly 600. For instance, a greater volumetric flow rate of ambient air can lower one or more of a temperature at which fluid is vaporized by atomizer 640 and/or a temperature of the vapor conveyed to a user of atomizer cartridge assembly 600. Accordingly, air inlet regulator 674 can be designed to provide a desired volumetric flow rate that is known to correspond to a desired vaporization temperature or vaporization temperature range. In some embodiments, the volumetric flow rate of ambient air through air inlet regulator 674 can be chosen to achieve a desired flavor intensity, e.g., the same amount of vaporized fluid carried in a greater volume of ambient air can result in a flavor that is milder or smoother than the same amount of vaporized fluid when carried in a smaller volume of ambient air.

What is claimed is:

1. An atomizer assembly, comprising:

a mouthpiece portion, wherein an outer surface of the mouthpiece portion includes a vapor outlet;

a longitudinal vapor channel, wherein a first distal end of the longitudinal vapor channel is coupled to the vapor outlet on the outer surface of the mouthpiece portion;

an internal fluid reservoir integrally formed with the mouthpiece portion as a single-piece construction, wherein the internal fluid reservoir comprises an empty volume disposed between an outer surface of the longitudinal vapor channel and an inner surface of the mouthpiece portion; and an atomizer configured to receive a fluid stored in the internal fluid reservoir of the mouthpiece portion, wherein the atomizer includes a longitudinal atomizer vapor channel and at least one heating element for vaporizing the fluid received from the internal fluid reservoir of the mouthpiece portion, the at least one heating element disposed along a surface of the longitudinal atomizer vapor channel.

2. The atomizer assembly of claim 1, wherein the internal fluid reservoir includes an open distal end substantially coplanar with a second distal end of the longitudinal vapor channel.

3. The atomizer assembly of claim 2, wherein the second distal end of the longitudinal vapor channel is coupled to the atomizer and receives a vaporized fluid produced by the atomizer.

4. The atomizer assembly of claim 3, wherein the atomizer produces the vaporized fluid using fluid conveyed from the internal fluid reservoir through the open distal end of the fluid reservoir.

5. The atomizer assembly of claim 3, wherein:

the atomizer comprises a porous ceramic material for absorbing fluid conveyed from the internal fluid reservoir through the open distal end of the internal fluid reservoir;

the at least one heating element contacts an inner surface of the porous ceramic material; and the vaporized fluid is produced by the heating element, using absorbed fluid at the inner surface of the porous ceramic material.

6. The atomizer assembly of claim 1, wherein:

the at least one heating element comprises a resistive heating element; and at least a portion of the resistive heating element is embedded in the surface of the longitudinal atomizer vapor channel.

7. The atomizer assembly of claim 1, wherein the atomizer is coupled to the mouthpiece portion such that the longitudinal atomizer vapor channel is aligned with a second distal end of the longitudinal vapor channel of the mouthpiece portion.

8. The atomizer assembly of claim 1, wherein the first distal end of the longitudinal vapor channel and the vapor outlet disposed on the outer surface of the mouthpiece portion are the same.

9. The atomizer assembly of claim 1, wherein the longitudinal vapor channel is disposed about a central longitudinal axis of the mouthpiece portion and the internal fluid reservoir surrounds at least a portion of the longitudinal vapor channel.

10. An mouthpiece assembly, comprising:

a mouthpiece portion, wherein an outer surface of the mouthpiece portion includes a vapor outlet;

a longitudinal vapor channel, wherein a first distal end of the longitudinal vapor channel is coupled to the vapor outlet on the outer surface of the mouthpiece portion;

an internal fluid reservoir integrally formed with the mouthpiece portion as a single-piece construction, wherein the internal fluid reservoir comprises an empty volume disposed between an outer surface of the longitudinal vapor channel and an inner surface of the mouthpiece portion; and an atomizer configured to receive a fluid stored in the internal fluid reservoir of the mouthpiece portion, wherein the atomizer includes at least one heating element for vaporizing the fluid received from the internal fluid reservoir of the mouthpiece portion;

wherein:

the atomizer comprises a porous ceramic material for absorbing fluid conveyed from the internal fluid reservoir through an open distal end of the internal fluid reservoir;

the at least one heating element contacts an inner surface of the porous ceramic material; and the vaporized fluid is produced by the heating element, using absorbed fluid at the inner surface of the porous ceramic material.

11. The mouthpiece assembly of claim 10, wherein the internal fluid reservoir includes an open distal end substantially coplanar with a second distal end of the longitudinal vapor channel.

12. The mouthpiece assembly of claim 11, wherein the second distal end of the longitudinal vapor channel receives a vaporized fluid produced by an atomizer.

13. The mouthpiece assembly of claim 12, wherein the atomizer produces the vaporized fluid using fluid conveyed from the internal fluid reservoir through the open distal end of the fluid reservoir.

14. The mouthpiece assembly of claim 10, wherein:

the atomizer includes a longitudinal atomizer vapor channel; and the at least one heating element is disposed along a surface of the longitudinal atomizer vapor channel.

15. The mouthpiece assembly of claim 14, wherein:

the at least one heating element comprises a resistive heating element; and at least a portion of the resistive heating element is embedded in the surface of the longitudinal atomizer vapor channel.

16. The mouthpiece assembly of claim 14, wherein the atomizer is coupled to the mouthpiece portion such that the longitudinal atomizer vapor channel is aligned with a second distal end of the longitudinal vapor channel of the mouthpiece portion.

17. The mouthpiece assembly of claim 10, wherein the longitudinal vapor channel is disposed about a central longitudinal axis of the mouthpiece portion and the internal fluid reservoir surrounds at least a portion of the longitudinal vapor channel.

* * * * *